US006062871A

United States Patent [19]

Arai et al.

[11] Patent Number: 6,062,871

[45] Date of Patent: May 16, 2000

[54] INTERCONNECTING ELECTRICAL CONNECTOR

[75] Inventors: Tetsuya Arai; Masayuki Nagashima, both of Tokyo, Japan

[73] Assignee: Hirose Electric Co., Ltd., Tokyo, Japan

[21] Appl. No.: 09/062,646

[22] Filed: Apr. 20, 1998

[30] Foreign Application Priority Data

Apr. 21, 1997 [JP] Japan ..... 9-116031

[51] Int. Cl.[7] ..... H01R 9/09; H01R 1/00

[52] U.S. Cl. ..... 439/66

[58] Field of Search ..... 439/66, 91, 591, 439/71

[56] References Cited

U.S. PATENT DOCUMENTS

| | | | |
|---|---|---|---|
| 3,954,317 | 5/1976 | Gilissen et al. | 339/17 E |
| 4,402,562 | 9/1983 | Sado | 339/61 M |
| 4,995,817 | 2/1991 | Grabbe | 439/71 |
| 5,169,321 | 12/1992 | Matsuoka | 439/71 |
| 5,308,252 | 5/1994 | Mroczkowski et al. | 439/66 |
| 5,395,252 | 3/1995 | White | 439/66 |
| 5,437,556 | 8/1995 | Bargain et al. | 439/66 |
| 5,498,166 | 3/1996 | Rothenberger | 439/66 |
| 5,573,435 | 11/1996 | Grabbe et al. | 439/862 |
| 5,655,913 | 8/1997 | Castaneda et al. | 439/66 |
| 5,746,607 | 5/1998 | Bricaud et al. | 439/66 |
| 5,759,048 | 6/1998 | Korsunsky et al. | 439/66 |

*Primary Examiner*—Steven L. Stephan
*Assistant Examiner*—Chandrika Prasad
*Attorney, Agent, or Firm*—Kanesaka & Takeuchi

[57] ABSTRACT

A contact element 1 comprises a fixing section 2 sufficiently strong to withstand insertion into a slit of an insulative housing 10, a transmission section 3 having contact points 3A and 3B projecting from the slit 12, and a flexible section 4 for linking the transmission section 3 to the fixing section 2. The contact points 3A and 3B are positioned so as to produce a bending moment about a linking portion 5 when they are brought into spring contact with mating connectors.

7 Claims, 9 Drawing Sheets

INTERCONNECTING ELECTRICAL CONNECTOR

BACKGROUND OF THE INVENTION

1. Field of the Invention

The present invention relates to an interconnecting electrical connector to be provided between a pair of mating connectors or the like for interconnecting them.

2. Description of the Related Art

Such an interconnecting electrical connector is disclosed in U.S. Pat. No. 5,395,252. As FIG. 11 shows, this connector has a contact element 51 which is made by stamping a metal sheet to provide a strip member having a pair of mounting wings 51A and is bent in the direction of sheet thickness to provide the substantially S-shaped contact element. A slit 53 is provided in a housing 52 and has a pair of retention grooves 54 in opposed side walls. The contact element 51 is held in the slit 53 by press-fitting the mounting wings 51A into the retention grooves 54 such that middle portions 51B are brought into spring contact with the side walls of the slit while both of the contact ends 51C project from the slit 51.

When mating connectors 61 and 62, such as circuit boards or IC packages, are mounted on the upper and lower surfaces of the interconnecting connector, the connection pads 61A and 62A are brought into spring contact with the contact ends 51C. In this way, the interconnecting connector is flanked by the mating connectors 61 and 62 to interconnect them.

The contact element of FIG. 11 has two functions; i.e., as a spring to provide contact forces with the mating connectors and a transmission path for transmitting signals. Since it is made in the form of an S-shape to provide a satisfactory spring characteristics, the transmission path becomes long. However, the increased speed of signals has made it difficult to meet the two requirements simultaneously. In transmitting high-speed signals, the shorter the contact element, the lower the self inductance of the transmission line. The short contact elements, however, provide limited movements of the contact points, failing to provide stable spring contacts.

The sliding movement of the contact points 51C with respect to the contact pads 61A and 62A is made by flexure of the contact points 51C about the middle points 51B. However, the contact points 51C extend substantially upwardly from the middle points 51B so that the amount of sliding movement is small. Consequently, the contact points 51C are brought into little sliding contact with the contact pads 61A and 62*a*, failing to provide the so-called "wiping effects." This leads to poor contact resulting from the accumulation of dirt and dust.

SUMMARY OF THE INVENTION

Accordingly, it is an object of the invention to provide an interconnecting electrical connector which is able to provide satisfactory sliding movement of the contact points, a short transmission path and a high reliability regardless of varied positions of the contact points or warping of the housing, excellent electrical characteristics and wiping effects, low manufacturing costs, and an easy assembling structure.

According to the invention there is provided an interconnecting electrical connector comprising an insulative housing having opposed surfaces and a plurality of slits extending between said opposed surfaces and a plurality of contact elements inserted into said slits. The contact elements have a plurality of movable contact points projecting from the insulative housing. When mating connectors are mounted on the insulative housing, the contact points are brought into spring contact with contact pads of the mating connectors to interconnect them.

The contact element comprises a rigid fixing section; a transmission section having a pair of contact points at opposite ends; and a flexible section connected to said transmission section at one end and to said fixing section at the other end via a linking portion.

The contact points are positioned so as to produce a bending moment about said linking portion when they are brought into contact with mating connectors.

When mating connectors are mounted on the housing of the interconnecting electrical connector, the contact points are brought into spring contact with the contact pads of the mating connectors to interconnect the mating connectors.

The transmission sections of the contact elements are so short that the distance of transmission path between the mating connectors is minimized.

The flexible sections are flexed by the bending moment caused by the mating connectors so that the contact points produce the wiping effects with respect to the contact pads of the mating connectors.

The flexible sections are made sufficiently long to provide satisfactory spring characteristics so that they also discharge a large amount of heat generated in the transmission sections.

The latch projection of the fixing section engages the latch shoulder of the slit to determined the insertion depth and the lateral position.

By inserting a pair of crank-shaped contact elements into slits arranged in a point symmetry, the respective contact points slide in opposite directions so that there is no shift or displacement of the mating connectors resulting from the sliding contacts of the respective contact elements.

By placing a plurality of angled contact elements in a straight line it is possible to effect a mass insertion of the contact elements into the slits by an automatic machine.

DESCRIPTION OF THE PREFERRED EMBODIMENT

Embodiments of the invention will now be described with respect to the accompanying drawings.

Figure 1:
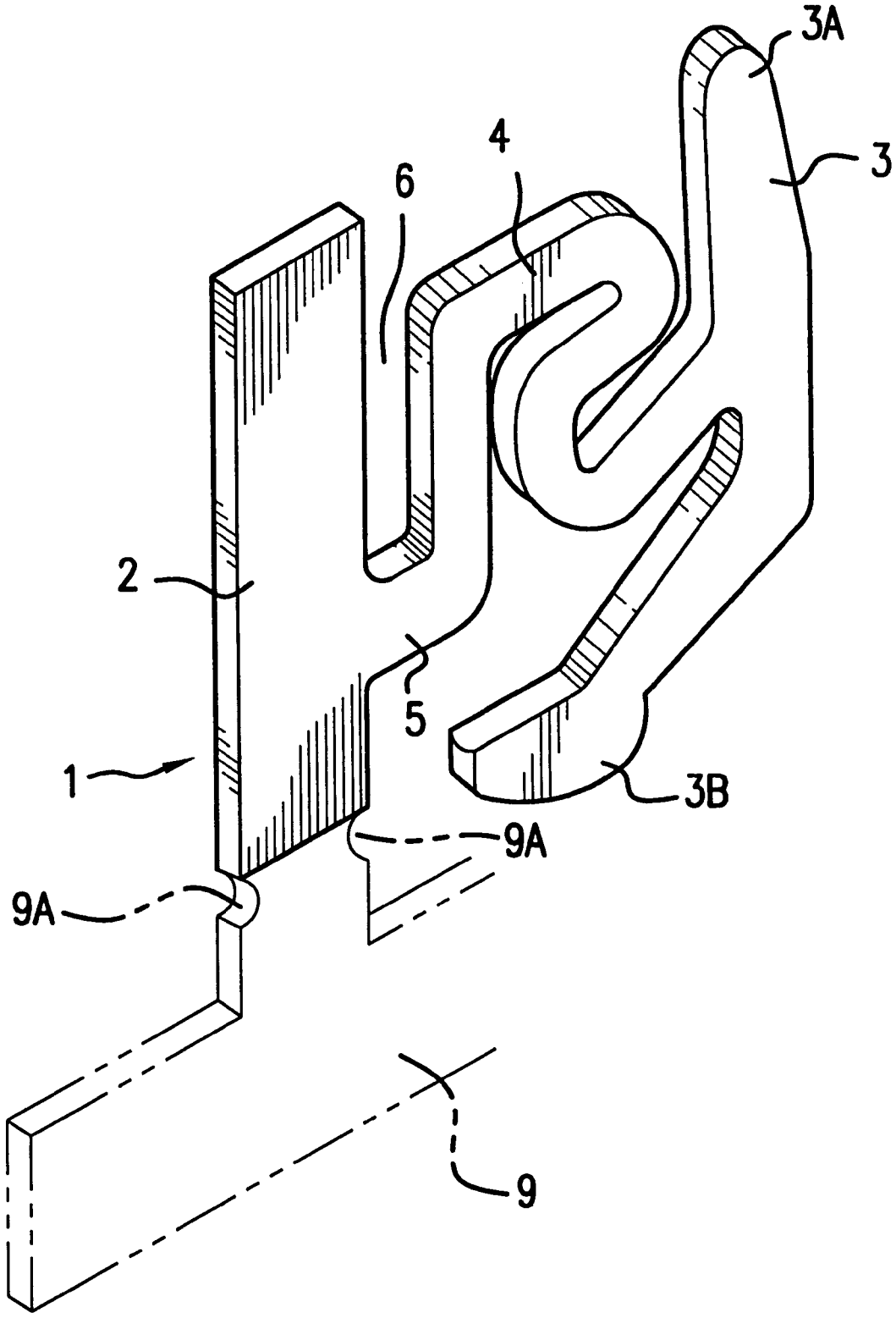
FIG. 1 is a perspective view of a contact element for an interconnecting connector according to an embodiment of the invention.

FIG. 1 shows a contact element for an interconnecting electrical connector. The contact element 1 is made by stamping a metal sheet and is flat and is not bent in the direction of thickness of the metal sheet. The contact element 1 comprises a vertical fixing section 2, a transmission section 3 beside the fixing section, and a flexible section 4 to connect the transmission section 3 to the fixing section 2.

The fixing section 2 has a width sufficiently rigid to withstand the insertion force with which the contact element is inserted into a slit of an insulative housing. The height of the fixing section 2 is set less than the depth of the slit. The flexible section 4 is connected to the fixing section 2 by a linking portion 5 and extends upwardly to form a clamping recess 6 and laterally in a few curves so that it is readily flexible.

The flexible section 4 is connected to the transmission section at the other end. The transmission section is made relatively rigid and has a vertical portion with a contact point 3A and a horizontal portion with a contact point 3B. When the contact element is housed in the slit, both of the contact points 3A and 3B are protruded from the slit to a certain extent. The positions of the contact points 3A and 3B are offset laterally.

Figure 2:
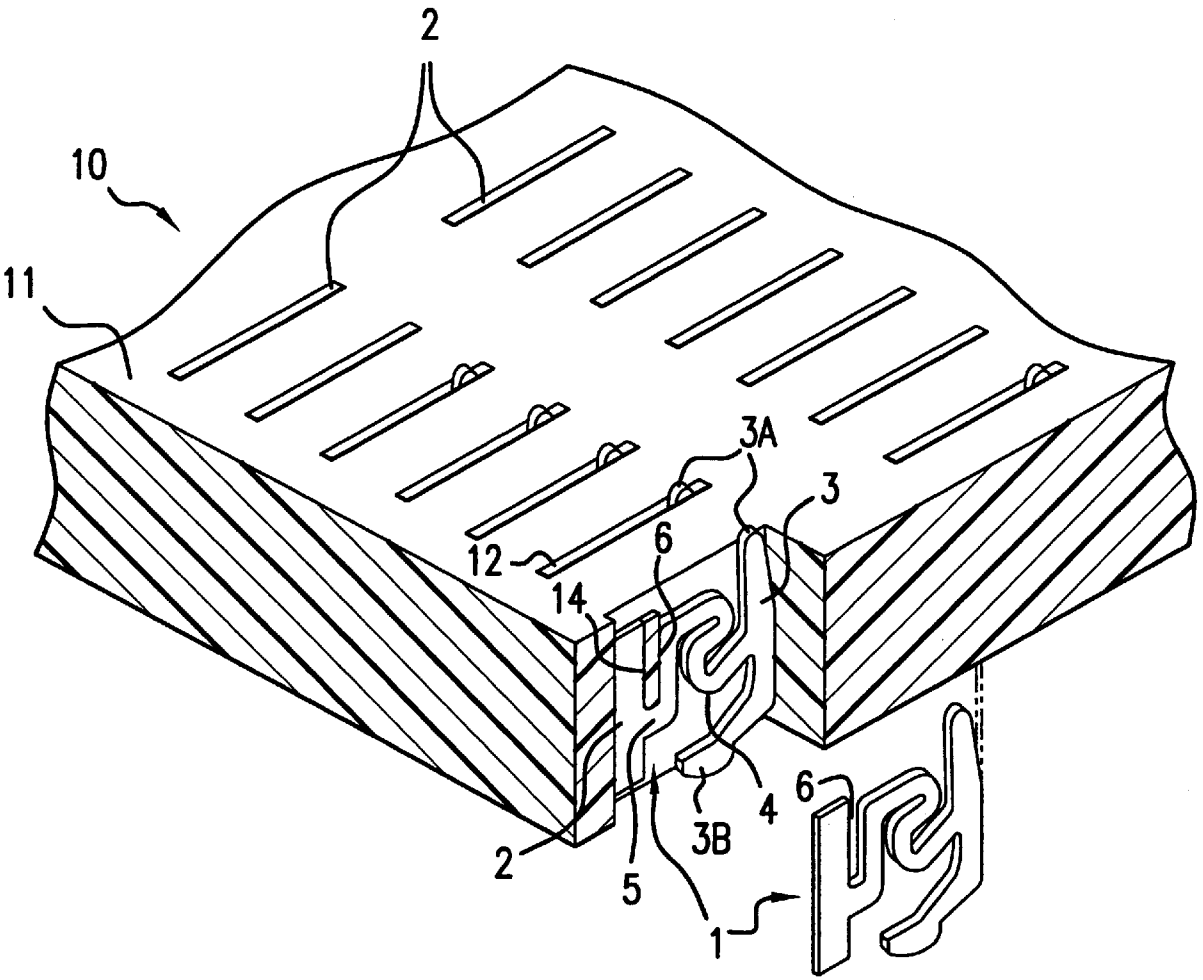
FIG. 2 is a partially cutaway perspective view of the interconnecting connector.

In FIG. 2, the insulative housing 10 has upper and lower flat surfaces 11 and a plurality of slits 12 extending between the two surfaces. A mating connector or the like is to be mounted on each of the surfaces 11.

Each of the slits 12 is made sufficiently large to accommodate one of the contact elements 1 and has an engaging island 14 therein. The contact element 1 is inserted into the slit 12 from the bottom, with the fixing section is held by an inserting tool. When the contact element 1 is inserted into the slit 12, the clamping recess 6 fits over the engaging island 14 to hold the contact element 1 such that the upper and lower contact points 3A and 3B project from the upper and lower surfaces 11.

Then, a mating connector is placed on each of the surfaces 11 of the insulative housing 10 such that the contact sections of the mating connector are brought into spring contact with the contact points 3A or 3B of the contact elements 1 so that the connectors on opposite surfaces are connected through the contact elements 1.

The contact sections 3A and 3B receive forces from the connectors, causing a bending moment about the linking portion 5 because their work points are offset laterally. The flexible section 4 is flexed about the linking portion 5 so that the contact points 3A and 3B are moved downwardly to the surfaces 11 of the housing 10. Consequently, the contact points 3A and 3B are moved not only in a vertical direction but also in a horizontal direction. As a result, the contact points 3A and 3B make sliding contact with the contact sections of the mating connectors, thus producing the wiping effects.

An electric current flows the shorter transmission section 3 between the contact points 3A and 3B rather than the longer flexible section 4. This transmission path is also considerably shorter than that of the conventional connector.

In FIG. 1, a plurality of contact elements 1 are connected to a carrier 9 at the fixing sections 2 to make simultaneous insertion into a plurality of slits by an automatic machine. After insertion, the contact elements 1 are cut off from the carrier 9 at notches 9A.

Figure 3:
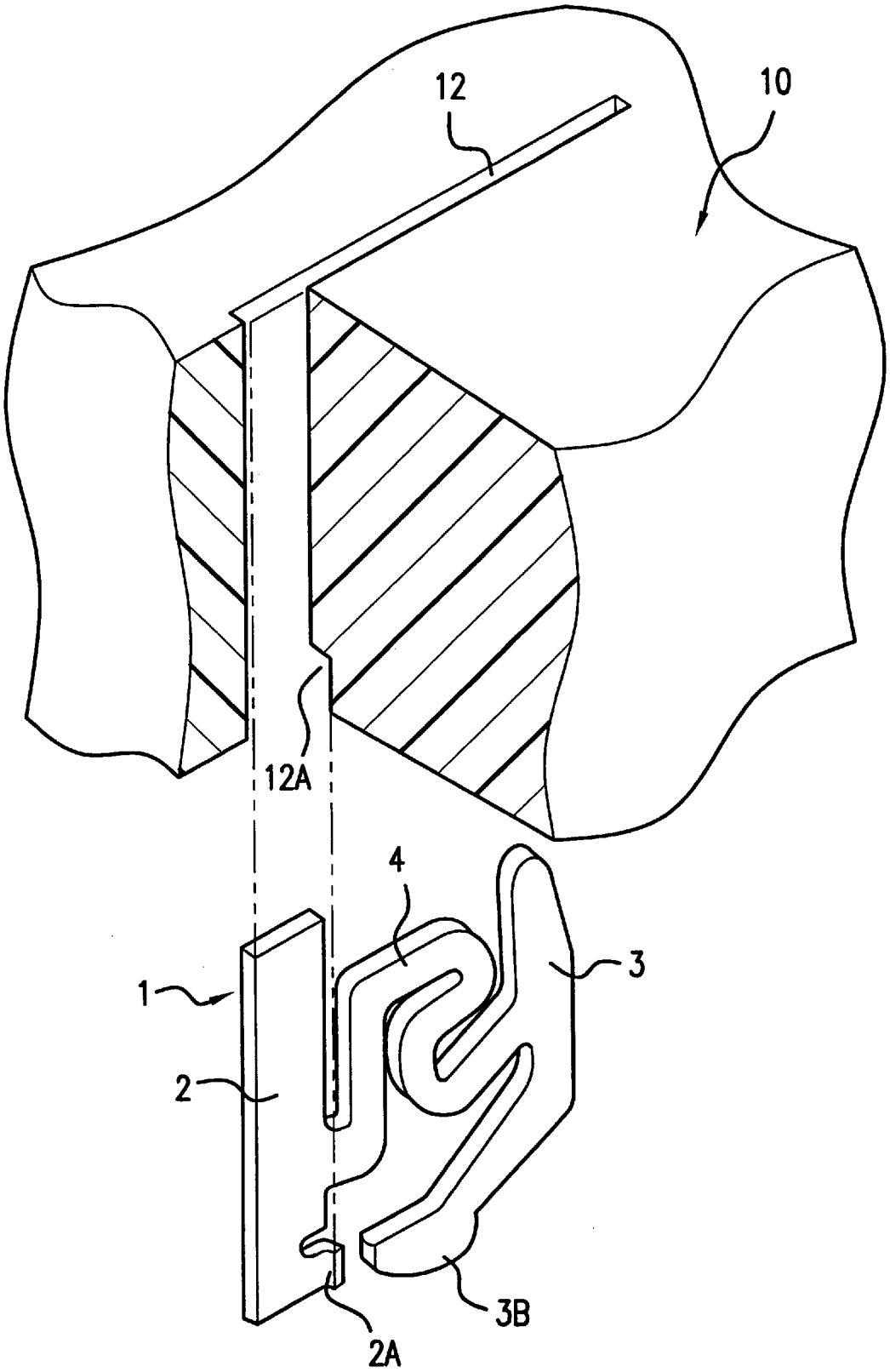
FIG. 3 is a perspective view of a contact element according to the second embodiment of the invention.

In FIG. 3, a portion of the fixing section 2 is bent at right angles with the fixing section 2 to provide a latch projection 2A, and a latch shoulder 12A is provided in the slit 12 of the insulative housing 10 at the position corresponding to the latch projection 2A. When the contact element 1 is inserted into the slit 12 from the bottom, the latch projection 2A engages the latch shoulder 12A, bringing the contact element into a predetermined insertion position.

Figure 4:
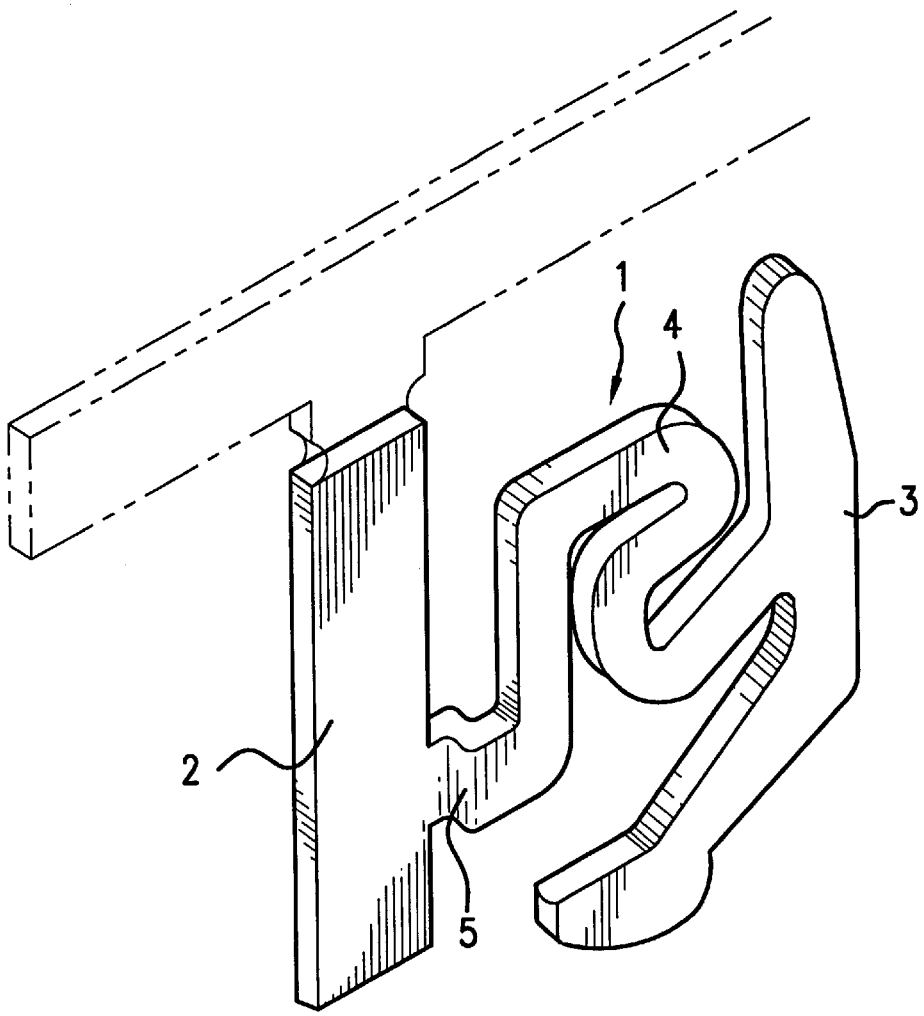
FIG. 4 is a perspective view of a contact element according to the third embodiment of the invention.
Figure 5:
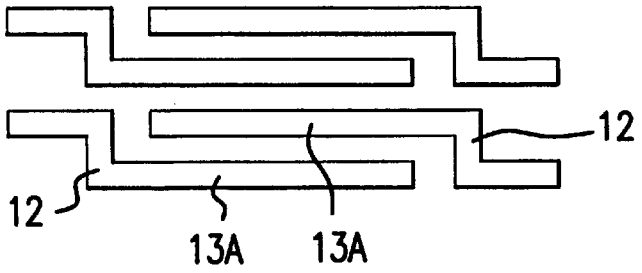
FIG. 5 is a plan view of slits for receiving the contact elements of FIG. 4.

In FIG. 4, the contact element 1 is bent at the linking portion 5 so that the fixing section 2 and the flexible section 4 are linked in the form of a crank as viewed from above. The slit 12 is also made in the form of a crank so as to receive the crank-shaped contact element 1. In FIG. 5, a plurality of slits 12 are provided such that each pair of slits 12 make a point symmetry and the receiving section 12A are parallel to each other. This makes it possible to insert identical contact elements 1 into the paired slits 12 in the reversed position so that the contact points 3A and 3B of theses contact elements are moved in opposite directions. Consequently, the plurality of contact elements offset each other in sliding contact, thus not only providing wiping effects but also minimizing poor contact resulting from a shift of the mating connector.

Figure 6:
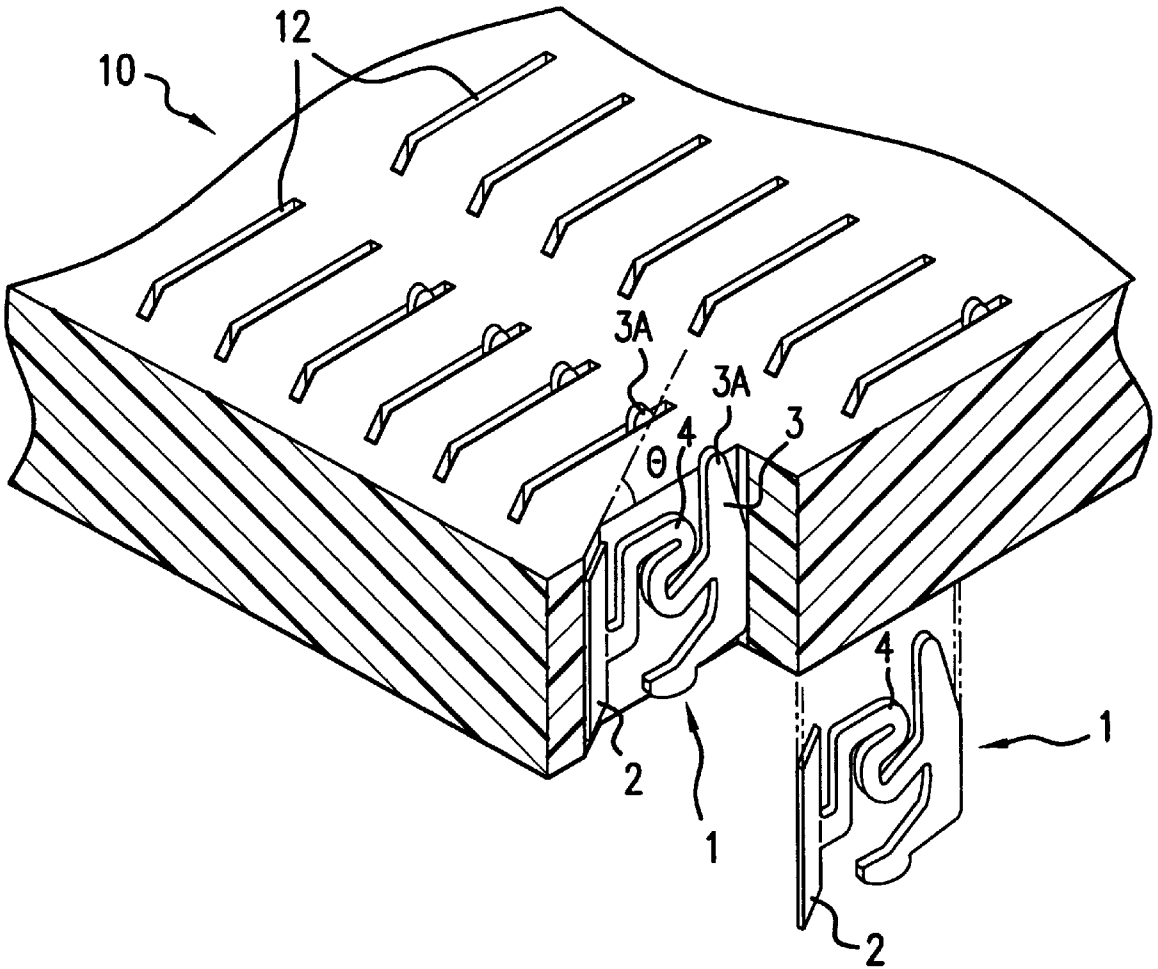
FIG. 6 is a partially cutaway perspective view of an interconnecting connector according to the fourth embodiment of the invention.

In FIG. 6, the fixing section 2 is connected to the transmission section 3 and the flexible section 4 at an angle θ. The portion of a slit 12 to receive the fixing section 2 also is made at the angle θ. Some abutment projections are provided on the fixing section 2 to abut against the walls of the slit 12 to provide a reactive gripping force. An engaging shoulder is provided on the wall of the slit 12 to determine the depth of insertion of the contact element. A plurality of contact elements are linked to a carrier such that the fixing sections lie in a plane (at the angle θ) for simultaneous insertion into slits by an automatic machine.

Figure 7:
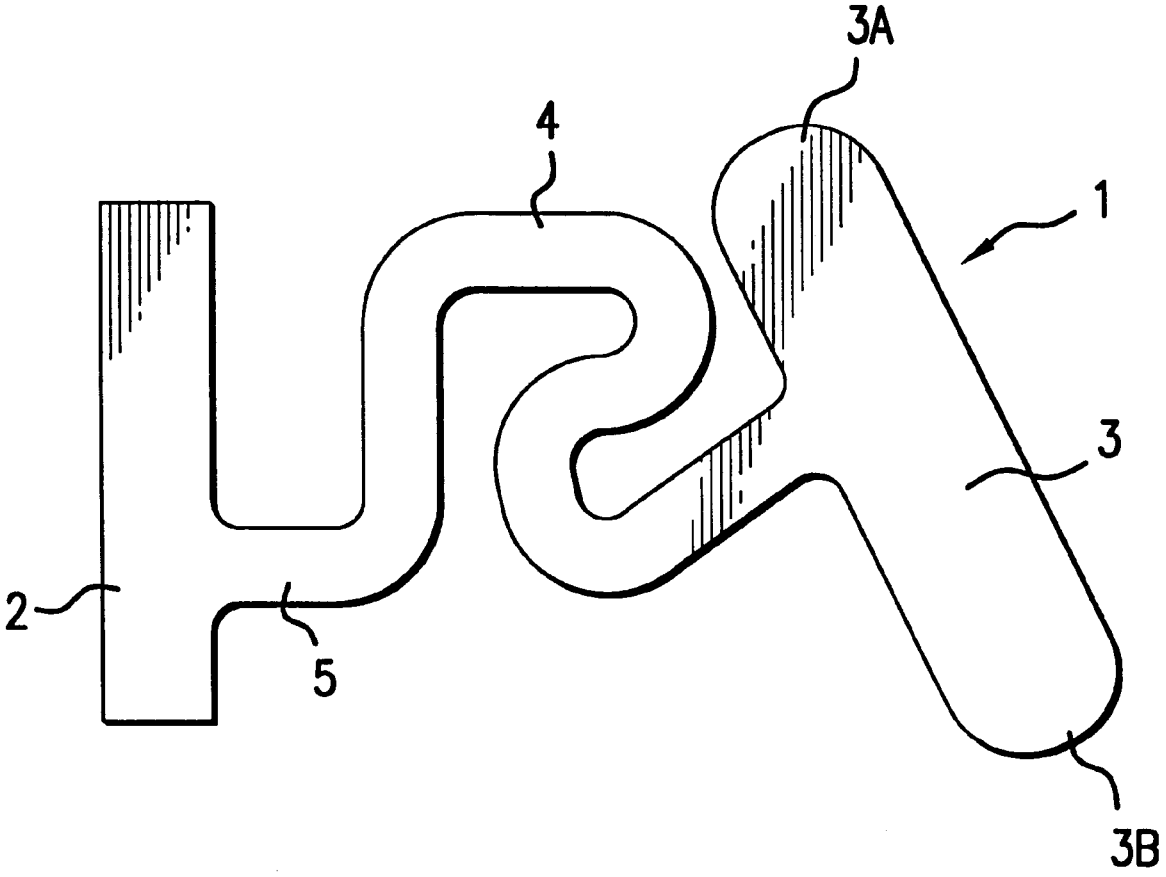
FIG. 7 is a side view of a contact element according to the fifth embodiment of the invention.
Figure 8:
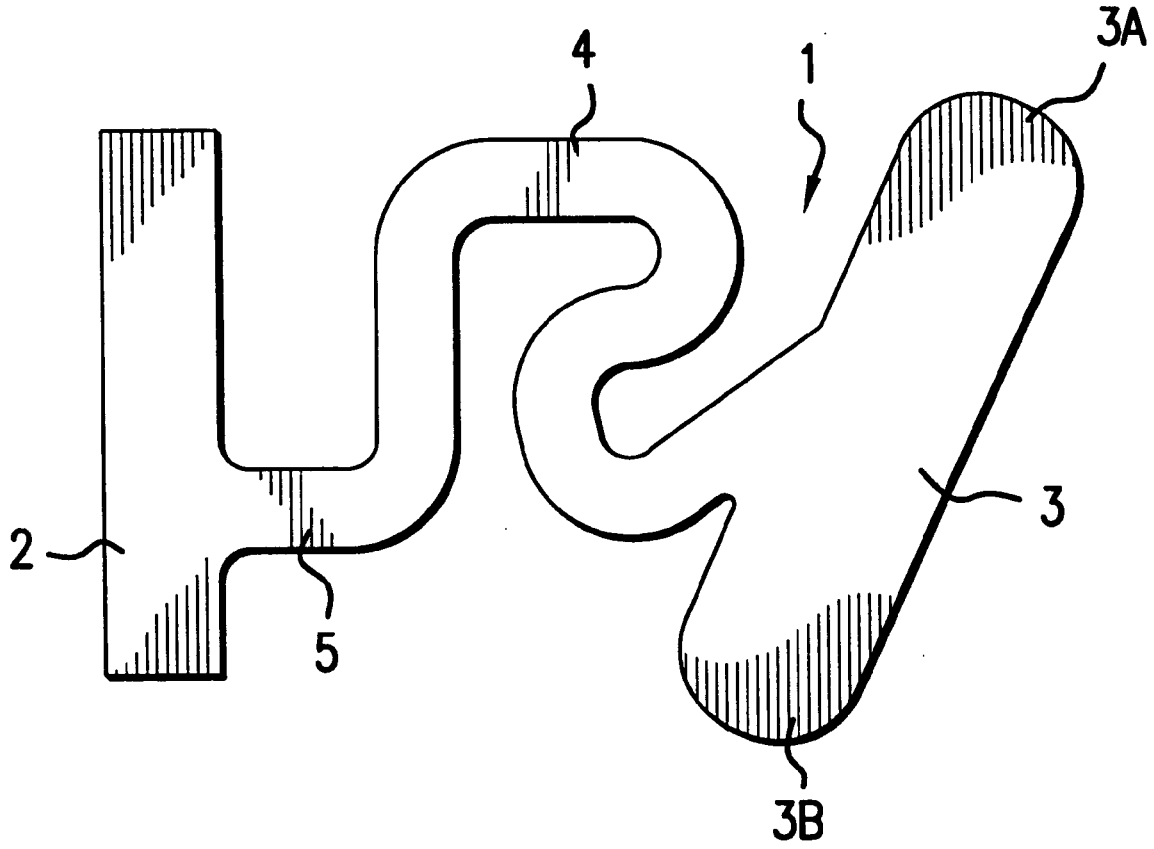
FIG. 8 is a side view of a contact element according to the sixth embodiment of the invention.

In FIG. 7, the transmission section 3 extends in a certain direction. In essence, the contact points 3A and 3B are connected by the minimum path and produce a bending moment about the linking portion 5 when they are brought into contact with the mating connectors. In FIG. 8, a line connecting the contact points 3A and 3B is inclined in opposite direction to that of FIG. 7.

Figure 9:
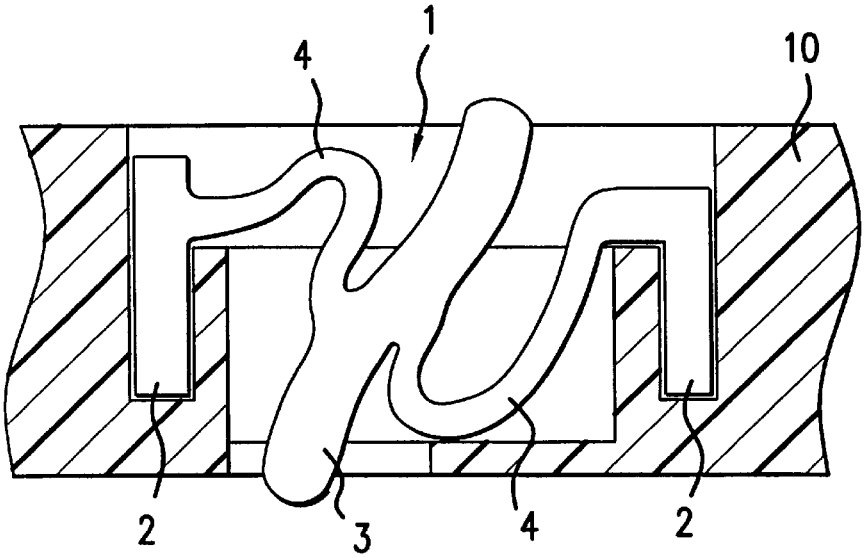
FIG. 9 is a side view of a contact element according to the seventh embodiment of the invention.

In FIG. 9, the contact element 1 has a pair of fixing sections 2, and the slit 12 of the housing 10 has a pair of recesses for accommodating the fixing sections 2. A pair of flexible sections are provided on opposite sides of the transmission section 3, maximizing the recovery force.

Figure 10:
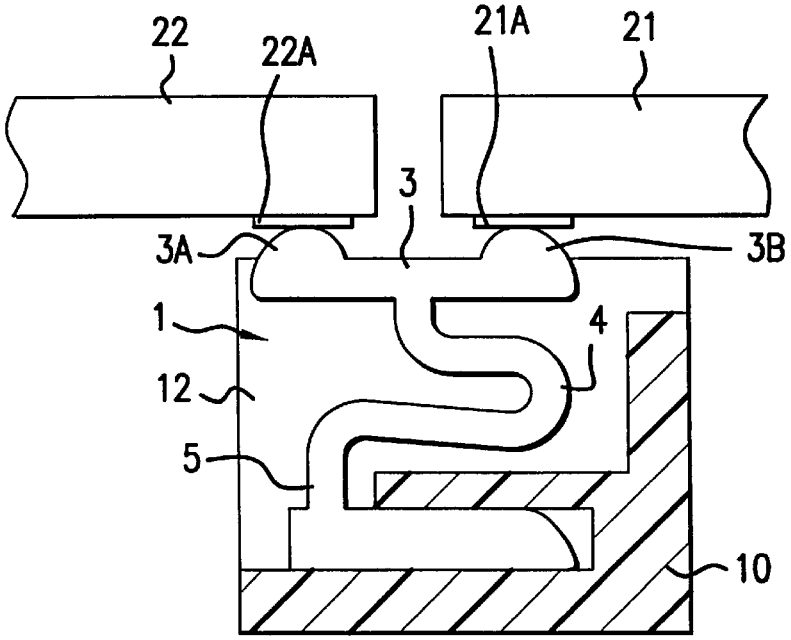
FIG. 10 is a side view of a contact element according to the eighth embodiment of the invention.
Figure 11:
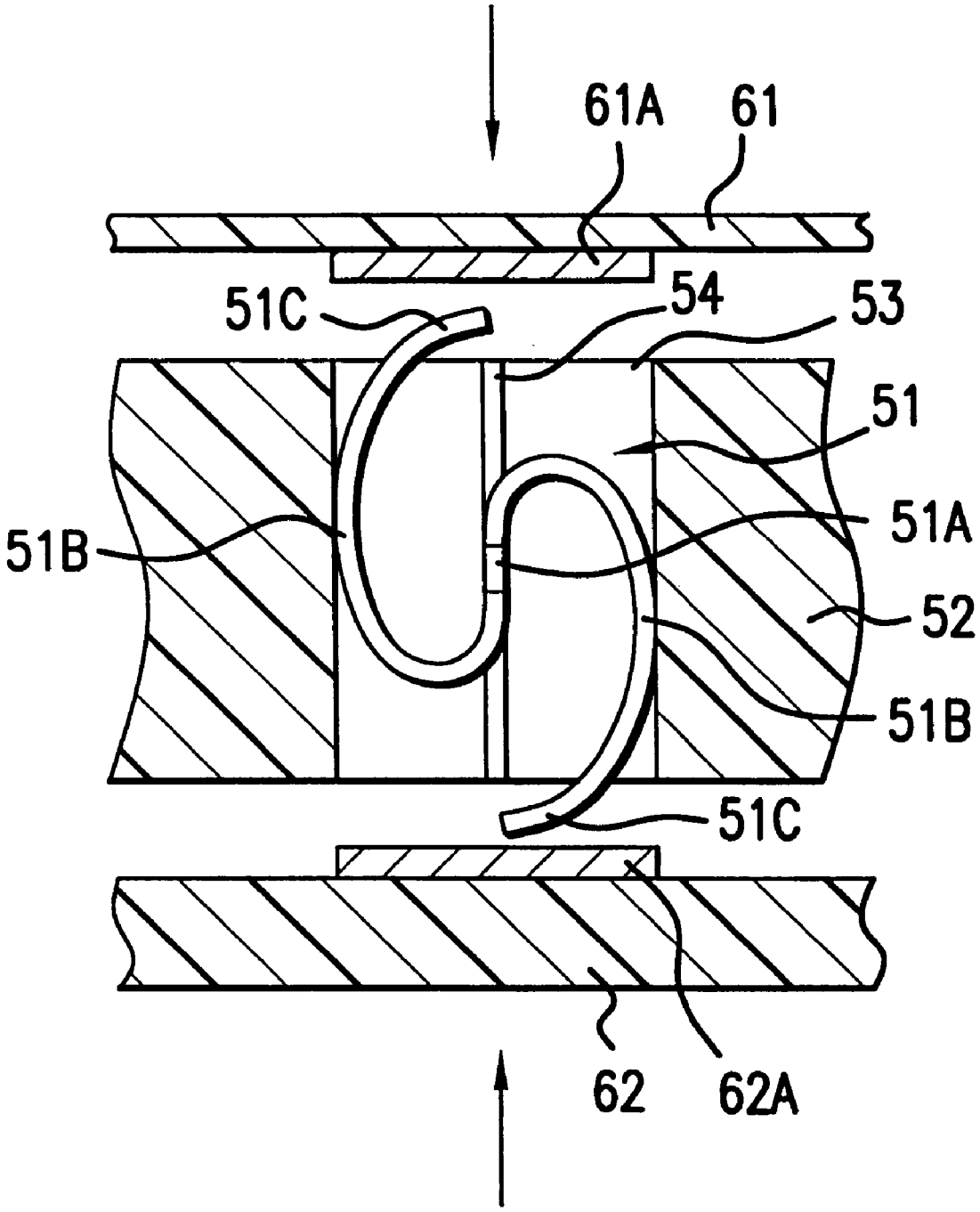
FIG. 11 PRIOR ART
FIG. 11 is a sectional view of a conventional interconnecting electrical connector.

In FIG. 10, a pair of contact points 3A and 3B are provided on one side of the transmission section 3 to connect adjacent connectors 21 and 22 on a surface of the housing 10. A slit 12 is provided at a corner of the housing 10, and a contact element 1 is inserted into the slit 12 from a side such that the contact points 3A and 3B project from the top of the housing 10. The connection pads 21A and 22A of the adjacent connectors 21 and 22 on the upper surface of the housing 10 are connected by the transmission section 3. The point of combined forces on the contact points 3A and 3B is offset from the linking portion 5 so that a bending moment is produced about the linking portion 5, thus flexing the flexible section.

According to the invention, first of all, the length of a transmission line is minimized regardless of the flexible section thereby providing a low self-inductance, excellent high-speed transmission characteristics including impedance matching, low conductive resistance, and high d.c. current capacity.

Second, the setting of spring characteristics of a flexible section is not restricted by transmission characteristics so that it is possible to provide a spring having large amounts of replacement. For d.c. current transmission, the heat generated in the transmission section is discharged from the flexible section, thus maximizing the current capacity.

Third, the contact points are brought into close contact with the contact portions of a mating connector, thus maximizing the wiping effects and improving the contact reliability.

Fourth, the rigid fixing sections are provided on contact elements so that a plurality of contact elements are pressed into the housing by holding a portion of the fixing sections, facilitating mechanical successive or simultaneous insertion of contact elements, thus maximizing the productivity

What is claimed is:

1. An interconnecting electrical connector comprising:

an insulative housing having opposed surfaces and a plurality of slits extending between said opposed surfaces; and a plurality of contact elements inserted into said slits, said contact elements each comprising:

a rigid fixing section;

a transmission section having a pair of contact points at opposite ends such that an electric current directly flows through said transmission section;

a flexible section connected to a middle of said transmission section at one end and to said fixing section at the other end via a linking portion.

2. An interconnecting electrical connector according to claim 1, wherein a part of said fixing section is bent to provide a latch projection for engagement with a latch shoulder provided in said slit.

3. An interconnecting electrical connector according to claim 1, wherein said linking portion is bent like a crank such that said fixing and flexible sections lie in two different parallel planes and a pair of said slits are arranged in a point symmetry, with flexible-section receiving sections of said slits being parallel to each other.

4. An interconnecting electrical connector according to claim 2, wherein said linking portion is bent like a crank such that said fixing and flexible sections lie in two different parallel planes and a pair of said slits are arranged in a point symmetry, with flexible-section receiving sections of said slits being parallel to each other.

5. An interconnecting electrical connector according to claim 1, wherein said fixing and flexible sections are connected at said linking portion at an angle and fixing-section receiving sections of said slits lying in a straight line.

6. An interconnecting electrical connector according to claim 2, wherein said fixing and flexible sections are connected at said linking portion at an angle and fixing-section receiving sections of said slits lying in a straight line.

7. An interconnecting electrical connector according to claim 1, wherein said pair of contact points are offset laterally so as to produce a bending moment for said flexible section about said linking portion and make sliding contact between said pair of contact points and contact sections of mating connectors when said pair of contact points are brought into contact with said mating connectors.

* * * * *